US009434082B2

(12) United States Patent
Spae

(10) Patent No.: US 9,434,082 B2
(45) Date of Patent: Sep. 6, 2016

(54) DUAL KNIFE FOOD CUTTER

(71) Applicant: Johnathan T. Spae, Austin, TX (US)

(72) Inventor: Johnathan T. Spae, Austin, TX (US)

( * ) Notice: Subject to any disclaimer, the term of this patent is extended or adjusted under 35 U.S.C. 154(b) by 108 days.

(21) Appl. No.: 14/155,313

(22) Filed: Jan. 14, 2014

(65) Prior Publication Data

US 2015/0197025 A1 Jul. 16, 2015

(51) Int. Cl.

| | |
|---|---|
| ***B26B 29/00*** | (2006.01) |
| ***B26B 3/00*** | (2006.01) |
| ***B26B 3/03*** | (2006.01) |
| ***B26B 3/04*** | (2006.01) |

(52) U.S. Cl.

CPC ..... *B26B 29/00* (2013.01); *B26B 3/03* (2013.01); *B26B 3/04* (2013.01)

(58) Field of Classification Search

CPC ..... B26D 3/24; B26B 3/03; B26B 5/007; B26B 9/00; B26B 9/02

See application file for complete search history.

(56) References Cited

U.S. PATENT DOCUMENTS

| | | | | |
|---|---|---|---|---|
| 1,414,098 | A * | 4/1922 | Santana | 30/315 |
| 1,425,750 | A * | 8/1922 | Crawford | 30/148 |
| 2,285,013 | A * | 6/1942 | Burns | B26B 3/00 30/165 |
| 3,890,707 | A * | 6/1975 | Cremonese | 30/340 |
| 4,924,575 | A * | 5/1990 | James | 30/315 |
| 4,959,905 | A * | 10/1990 | Ghislain | 30/298.4 |
| 5,101,530 | A * | 4/1992 | Hansen et al. | 15/245 |
| 5,920,992 | A * | 7/1999 | Watermolen et al. | 30/315 |
| D488,682 | S * | 4/2004 | Bertke | D7/693 |
| D729,597 | S * | 5/2015 | Bagley | D7/693 |
| 9,021,929 | B2 * | 5/2015 | Cordova et al. | 83/34 |
| 2012/0042520 | A1 * | 2/2012 | Simeray | 30/143 |
| 2012/0198707 | A1 * | 8/2012 | Blacken | 30/346 |
| 2012/0304469 | A1 * | 12/2012 | Powell | 30/143 |
| 2015/0197025 | A1 * | 7/2015 | Spae | B26D 3/24 |

* cited by examiner

*Primary Examiner* — Hwei C Payer

(57) ABSTRACT

A dual knife food cutter apparatus is configurable into a cutting configuration and a storage configuration. It comprises two substantially identical blades and a handle apparatus with slots. In the cutting configuration, the first blade is attached to the second blade to form a substantially contiguous combined cutting edge. In the storage configuration, the cutting side of each blade is inserted into the slot of the handle of the other blade to protect users from accidental cuts.

9 Claims, 17 Drawing Sheets

DUAL KNIFE FOOD CUTTER

This application claims the benefit of priority from U.S. Provisional Patent Application Ser. No. 61/752,235 filed on Jan. 14, 2013 and entitled "Dual Knife Food Cutter", which is fully incorporated herein by reference for all purposes.

BACKGROUND OF THE INVENTION

This invention relates to food cutting devices commonly used in households and commercial applications. More particularly, it relates to food cutting devices used to cut food items like pizza, tortillas, quesadillas, pies, pastries, brownies & baked goods, caramels, as well as mincing herbs & vegetables. Rocker food cutting devices are well known. In such rocker food cutting devices, the blade of the knife is curved convexly to provide a cut with a simple rocking motion of the knife. Exemplary of the prior art is:

Santana U.S. Pat. No. 1,414,098 is a cigar-maker's knife with a convex blade and a rolled integral handle.

Watermolen et al U.S. Pat. No. 5,920,992 is a pizza cutter with a convex blade with two handles providing finger indentations.

Ghislain U.S. Pat. No. 4,959,905 is a pizza cutting device with a convexly curved blade with a handle extending the length of the blade. The food cutting device can be stored in a separate holder that receives the blade when not in use.

James U.S. Pat. No. 4,924,575 is a pizza knife with convex blade with an integral handle that extends the length of the blade.

Cremonese U.S. Pat. No. 3,890,707 is a kitchen knife with a straight edge in the back with an attached handle spanning a portion of the blade with an aperture below for fingers to wrap around. The blade being curved from the straight edge in the back to the point in the front.

All of the aforementioned food cutting devices are cumbersome to store when not in use. A common place to store a food cutting device like this would be a drawer, but they are large and have exposed blades, and in the case of U.S. Pat. No. 4,959,905, requires storage outside of a drawer because of the large holder of the blade. The present invention overcomes this storage issue by breaking down into two separate knives that are stored with each knife's blade being stored in the handle of the other. The storage position of the present invention is therefore smaller and easier to store in a drawer along with other kitchen tools, and safer because the knife blades are stored securely in the handles.

SUMMARY OF THE INVENTION

The present invention overcomes two problems associated with existing food cutters, more specifically, the size issue and safety issue of storing the food cutting device. The storage configuration of the present invention is half the size of the full food cutter making the food cutter easier to store with other kitchen tools. The present invention is also safer than current food cutting device because the blades of the knives are safely stored inside the handles when in storage position. The present invention also has the added benefit of being two individual knives for use in cutting smaller food items such as tortillas, herbs, and the like.

BRIEF DESCRIPTION OF THE DRAWINGS

In the accompanying drawings which form a part of the specifications and are to be read in conjunction therewith and in which like reference numerals are used to indicate like parts in the various views.

DETAILED DESCRIPTION OF THE INVENTION

Figure 1:
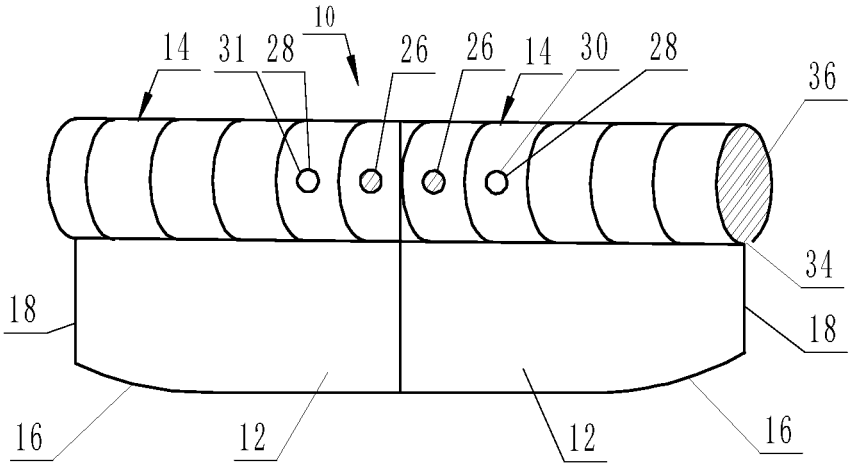
FIG. 1. Is a perspective view of a dual knife food cutter constructed according to an embodiment of the invention.
Figure 5:
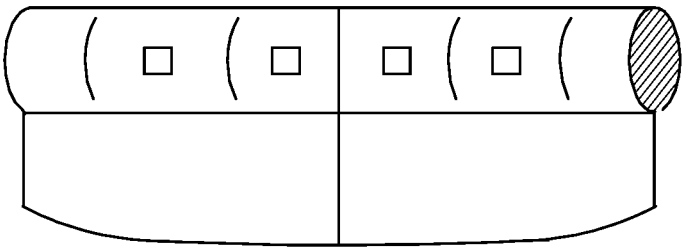
FIG. 5. Is a perspective view of a dual knife food cutter with the handle side of the first blade and second blade fixedly attached to the cutting side and not formed integrally out of the same material.
Figure 9:
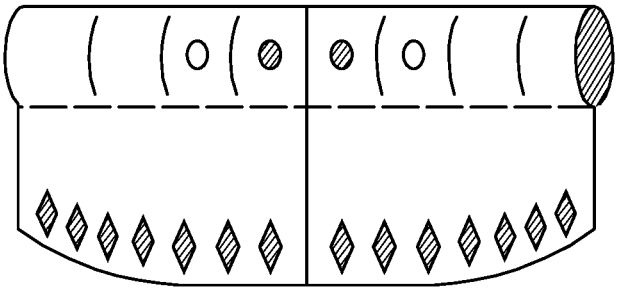
FIG. 9. Is a perspective view of a dual knife food cutter with a Granton edge on the cutting side.
Figure 10:
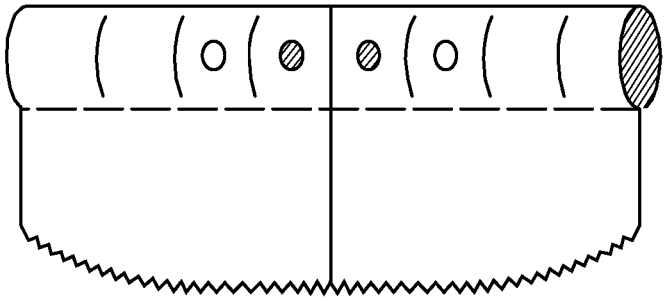
FIG. 10. Is a perspective view of a dual knife food cutter with a serrated edge on the cutting side.

Referring now to the drawings in more detail, in FIG. 1 numeral 10 generally designates a dual knife food cutter apparatus configurable into a cutting configuration and a storage configuration. In this embodiment the handle side 14 of the first blade and second blade is formed integrally from the same material as the cutting side 16. The blade 12 and the integral handle 14 are formed as a single stainless steel piece in this embodiment, but in other embodiments the apparatus is comprised of material in a group consisting of food grade metal, rigid plastic, carbon fiber, ceramic, or wood. Also, in other embodiments the handle side of the first blade and second blade is fixedly attached to the cutting side and not formed integrally out of the same material as referenced in FIG. 5. The cutting side 16 of the first blade and the cutting side 16 of the second blade have a sharpened edge in this embodiment. The cutting side 16 of the first blade and the cutting side 16 of the second blade also have a convex edge to provide a cut with a simple rocking motion of the knife in this embodiment. In another embodiment referenced in FIG. 9 the cutting side of the first blade or second blade, or both blades, further comprises a Granton edge. Or in another embodiment referenced by FIG. 10, the cutting side of the first blade or second blade, or both blades, further comprises a serrated edge. Although the dimensions can vary, the total combined blade length of the dual knife food cutter should be long enough to cut conventionally sized pizzas, which would be in the range of 12 inches up to 24 inches. In this embodiment the blade length and full food cutter length is 13 and ¾ inches. The full food cutter in this embodiment is 3 and ¾ inches in width from the top of the handle to the bottom of the middle of the dual knife food cutter. This could range from 2 inches to 8 inches in other embodiments. The full food cutter in this embodiment is 2 and ½ inches in width from the top of the handle to the bottom of the front side 18. This could range from 1 inch to 7 inches in other embodiments.

The cutting side 16 of the first knife and second knife has a sharpened edge in this embodiment and the cutting side 16 extends along substantially the entirety of the bottom portion of the blade 12. However, on opposite end 18 of the blade 12, which is a front side adjacent to the cutting side, it is preferred that the blade edge not be sharpened in this embodiment in order to avoid possible inadvertent cutting of the hands when the food cutter is used.

Figure 3A:
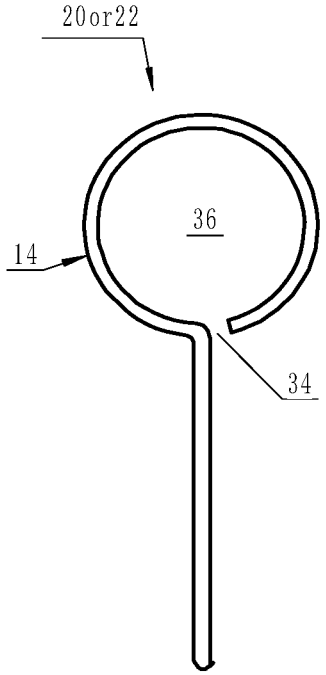
FIG. 3A. Is an end view of one of the individual knives with integral handle according to an embodiment of the invention.
Figure 4A:
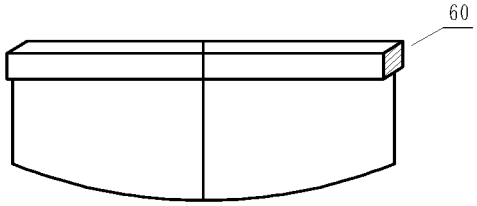
FIG. 4A. Is a perspective view of a food cutter with a square handle side according to an embodiment of the invention.
Figure 4B:
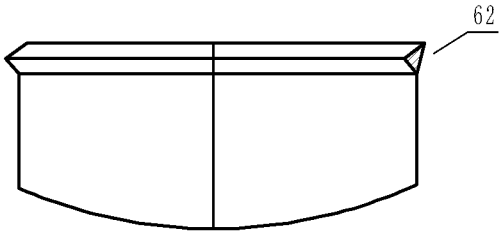
FIG. 4B. Is a perspective view of a food cutter with a triangle handle side according to an embodiment of the invention.

In this embodiment there is a handle side 14 opposite to the cutting side and substantially parallel to the cutting side comprising a hollow channel fixedly attached to the blade further comprising a slot in the channel wherein the slot is sized to allow insertion of the cutting side of a second blade. In this embodiment the handle side of the first blade and second blade and the connector are cylindrical shaped tubes. The hollow channel 36 extends the length of the blade. The interior diameter of the hollow channel 36 is 1 inch in size in this embodiment but could range from ¼ inch to 4 inches in other embodiments of the invention. In other embodiments the handle side of the first blade and the connector comprise a polygon shaped cross section. In other embodiments the handle side and connector are square, triangle, or another shape as referenced in FIG. 4. As referenced in FIG. 3A, the handle side 14 is formed so the blade extends down from the middle of the handle side in this embodiment. The hollow channel of the handle side has a slot 34 which extends the length of the handle side 14 which has a width of approximately ⅛ inch in this embodiment, and could range in size from 1/16 inch to 1 inch in other embodiments.

Figure 2:
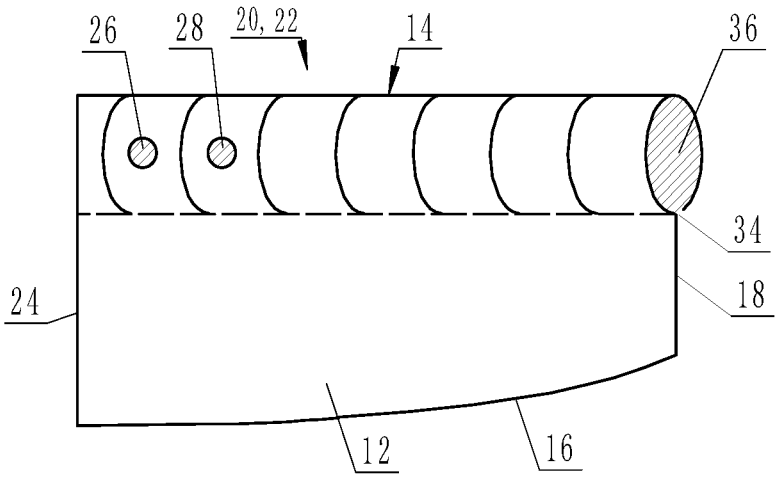
FIG. 2. Is a front elevation view of one of the two knives that can be used separately and to form the complete dual knife food cutter in an embodiment of the invention.

Referring to FIG. 2, knife 20 or 22 is a first blade made of rigid material. In this embodiment the full food cutter is divided down the middle to provide two knives of equal size. In another embodiment the individual knives are manufactured separately. It should be made clear that regardless if the two knives are manufactured separately or as one full food cutter, the two knives 20 & 22 can be used interchangeably in this embodiment of the invention. The second blade is substantially identical to the first blade. In this embodiment the individual knives are 6 & ⅞ inches each in length but the lengths could range from 6 inches to 12 inches in other embodiments. The widths of the knives are the same as the full food cutter, 3 and ¾ inches from the top of the handle down the end of a back side 24 opposite of the front side 18 substantially perpendicular to the cutting side, and 2 and ½ inches from the top of the handle down to the end of front side 18. These widths could range from 1 to 8 inches in other embodiments. With the back side 24 of the blade 12, as front side 18, it is preferred in this embodiment that these sides not be sharpened in order to avoid possible inadvertent cutting of the hands when the knife is used. Two holes 26 & 28 are drilled through handle side 14 and are located in the same position on each side of the handle. The holes in this embodiment are ¼ inch but could be 1/16 to 1 inch in other embodiments. Holes 26 & 28 referenced in FIG. 2 serve to lock in the spring clips 30 & 31 of the connector 32 referenced in FIG. 3B and FIG. 3C. The spring clip buttons that lock into the holes in this embodiment are ¼ inch but could be 1/16 to 1 inch in other embodiments. In this embodiment there is a connector sized for insertion into the hollow channel of the handle side of the first blade and the hollow channel of the handle side of the second blade. Also in this embodiment the handle side of the first blade further comprises holes and the connector further comprises spring clip buttons wherein the holes and spring clip buttons are aligned to secure the connector into the handle side of the first blade when in the cutting configuration.

Figure 3B:
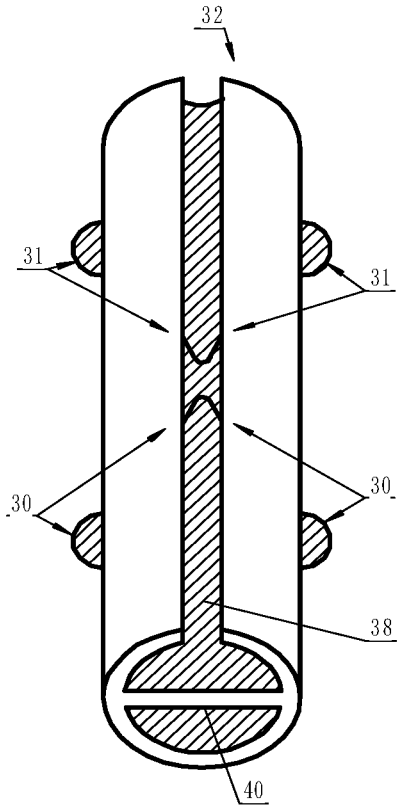
FIG. 3B. Is a perspective view of the connector with spring clips located inside the connector that are locked in holes of the connector in an embodiment of the invention.
Figure 3C:
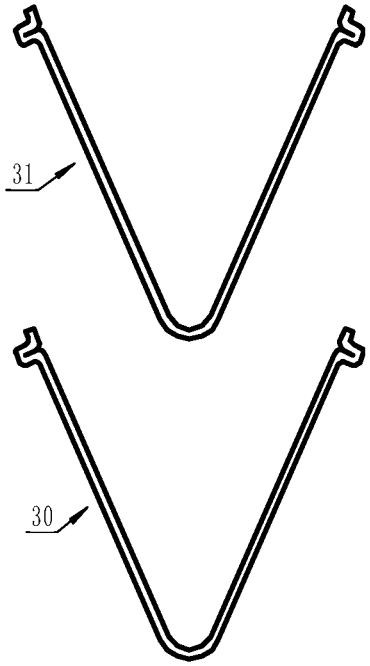
FIG. 3C. Is a front elevation view of the two spring clips used in an embodiment of the invention.
Figure 13A:
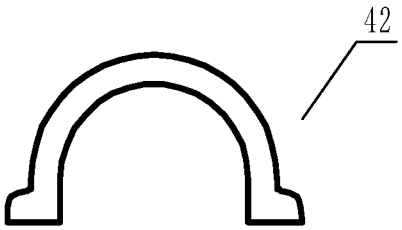
FIG. 13A. Is a front elevation view of a spring clip with a semi-circle shape.
Figure 13B:
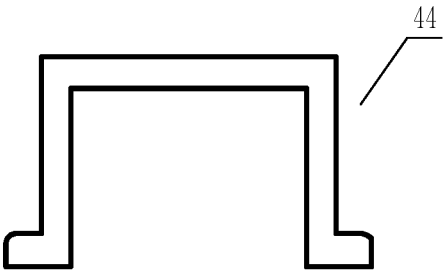
FIG. 13B. Is a front elevation view of a spring clip with a square shape.
Figure 13C:
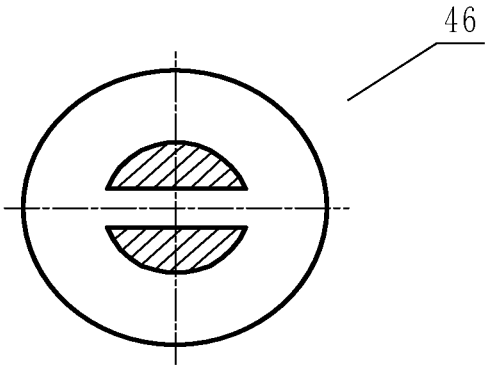
FIG. 13C. Is a front elevation view of a side cap for the connector that can be used to pull the connector from the handle side of the knife in storage position.
Figure 13D:
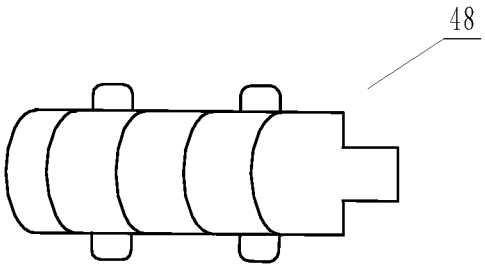
FIG. 13D. Is a perspective view of the connector with a tab extending out of the connector and past the handle side of the knife in storage position.

Referencing FIG. 3B and FIG. 3C, spring clips 30 & 31 are inserted in connector 32. Spring clips 30 & 31 have tension when squeezed that provide an adequate locking mechanism to the holes inside the connector 32 and then in the holes of the handle sides of the knives. The spring clips will automatically lock into place when a hole is found because of this inherent tension while squeezed. The leg length for the spring clips used in this embodiment are 1 and ½ inches but the size of the clips could range from ½ inch to 4 inches in other embodiments. In another embodiment spring clips that are a semi-circle shape 42 as referenced in FIG. 13A are used and fit into the connector while hugging the side of that connector. A square shaped spring clip 44 referenced in FIG. 13B is used to hug the side of a square shaped connector in another embodiment. Spring clips 30 & 31 and connector 32 referenced in FIG. 3B and FIG. 3C are made in this embodiment from stainless steel but in other embodiments the spring clips and connector can be comprised of other food grade metals or plastic. The connector 32 is of the exterior diameter size to be a tight fit within the interior diameter of the hollow channel 36 referenced in FIG. 3A. The connector has an exterior diameter slightly smaller than 1 inch in this embodiment but could be ¼ inch to 4 inches in other embodiments. The length of the connector 32 is 5 inches in this embodiment but could be 3 inches to 15 inches depending on the length of the full food cutter in other embodiments. Connector 32 has a slot 38 which has a width of approximately ⅛ inch in this embodiment. In other embodiments this slot could range in size from 1/16 inch to 1 inch. In this embodiment the connector stays exposed outside of the hollow channel of the knife handle when in storage position in order to pull the connector out from the handle. 1 inch of the connector is outside of the hollow channel in this embodiment as referenced in FIG. 8. In other embodiments ¼ inch to 4 inches of the connector remains exposed in order to pull the connector from the handle. In another embodiment referenced in FIG. 3B, connector 32 has a bar 40 at the side end in which to grab and pull out the connector when in storage position. In other embodiments there is a cap 46 at the side end with a bar located inside the cap 46 referenced in FIG. 13C or a tab 48 at the side end of the connector 32 referenced in FIG. 13D.

Figure 6:
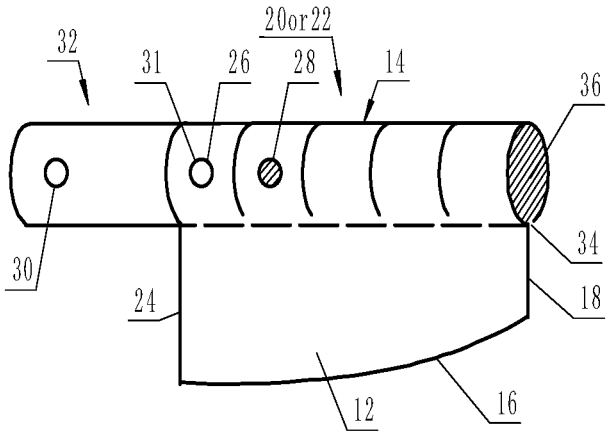
FIG. 6. Is a perspective view of one of the two knives with the connector attached which can be used as a handle extension for the individual knife and to connect the two knives to form the complete dual knife food cutter.

Referencing FIG. 6, connector 32 is inserted into knife 20 or 22. It should be made clear that this arrangement is the same when using either knife 20 or 22. Spring clip 31 of the connector tube is locked into place in hole 26 of the handle side of the knife. This arrangement is considered the butcher knife configuration of this embodiment of the invention. The connector is used as a handle extension for the handle side of the individual first or second knife. In other embodiments the other spring clip 30 or the other hole 28, or other combinations of the spring clips and holes can be used for this handle extension.

Figure 7:
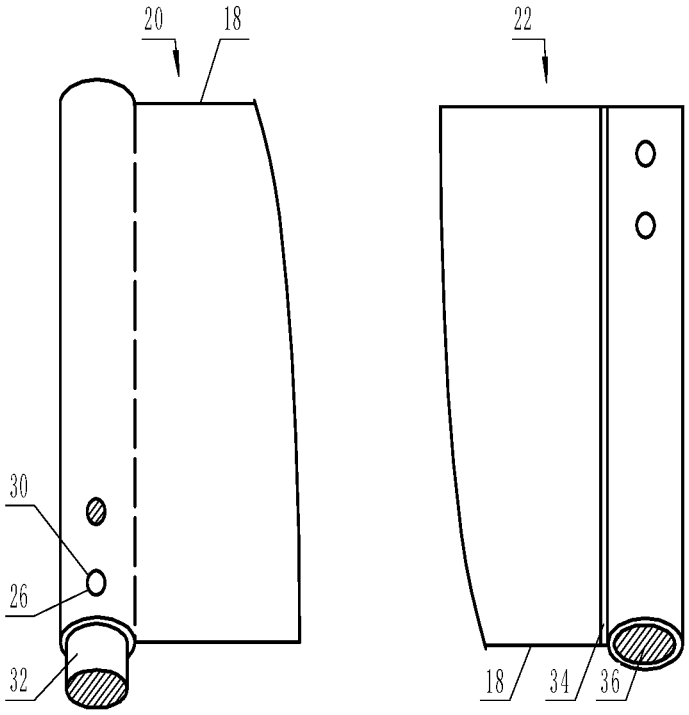
FIG. 7. Is a front elevation view of the two knives facing opposite sides being in the position for storage in an embodiment of the invention.

Referencing FIG. 7, knife 20 and knife 22 are positioned to be opposite of one another. It should be made clear again that the two knives can be used interchangeably in this embodiment. Knife 20 is placed with the front side 18 up and knife 22 with the front side 18 down. Knife 22 has the slot 34 exposed within view, while knife 20 does not in this scenario. Knife 20 has the connector 32 inserted into the hollow channel 36. The slot 38 of the connector referenced in FIG. 3B will line up with the slot 34 of the knife. Spring clip 30 locks into place with hole 26 in this configuration.

Figure 8:
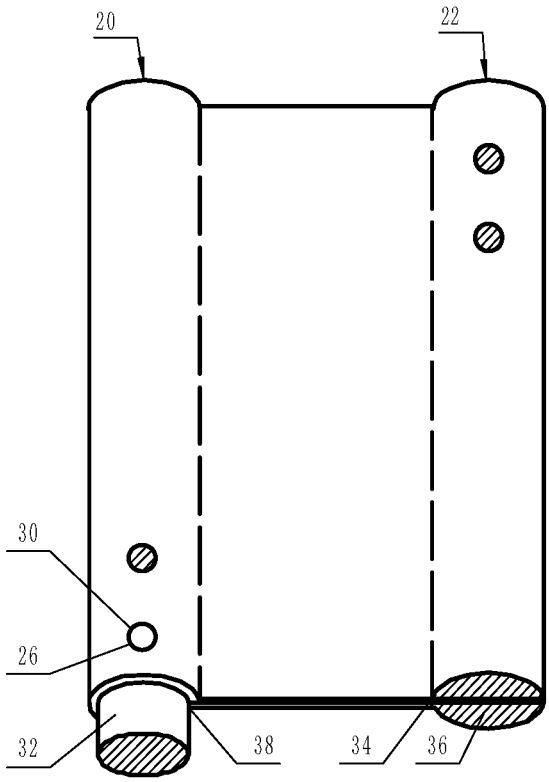
FIG. 8. Is a front elevation view of the final storage position in an embodiment of the invention. The cutting side of each blade is stored within the handle side of the other blade. The connector extends out past the end of the handle side of the knife in order to grab and pull out the connector from the handle side in an embodiment of the invention.

Referencing FIG. 8, wherein in the storage configuration, the cutting side of the first blade is inserted into the slot of the handle side of the second blade and the cutting side of the second blade is inserted into the slot of the handle side of the first blade. The cutting sides have a secure fit inside slot 34. The connector 32 is also inserted into the hollow channel 36. The cutting sides of the blades fit within the connector slot 38.

Returning to FIG. 1, wherein in the cutting configuration, the first blade is attached to the second blade such that the back side of the first blade abuts the back side of the second blade, the cutting side of the first blade and the cutting side of the second blade form a substantially contiguous combined cutting side. In this embodiment connector 32 is inserted into one knife with spring clip 31 locking into hole 28. Knives 20 & 22 are brought together with back side 24, referenced in FIG. 2, of each knife facing the other. Connector 32 is inserted into the other knife and spring clip 30 is locked into hole 28 of the other knife. The connector attaches the knives so the back sides abut each other and the cutting side of the first blade and the cutting side of the second blade form a contiguous cutting side. This arrangement is considered the full food cutter configuration in this embodiment of the invention.

Figure 11:
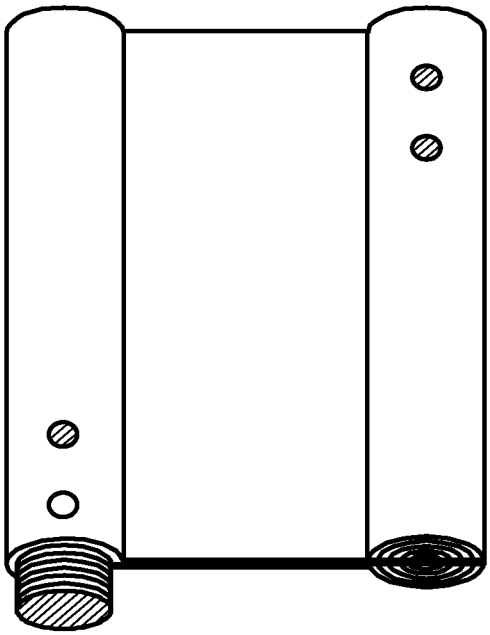
FIG. 11. Is a front elevation view of a screw type connection for the dual knife food cutter wherein one blade has a male member protruding from the handle side with threading on the exterior and the other blade has a female connection in the handle side with threading on the interior according to an embodiment of the invention.
Figure 12A:
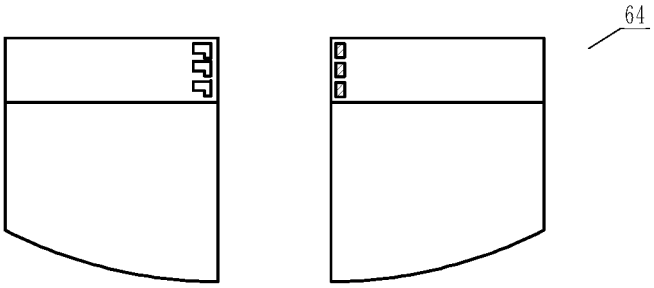
FIG. 12A. Is a front elevation view of another embodiment wherein the first blade and second blade are attached with a bayonet type connection where outwardly projecting L-shaped grooves from a slightly extended handle side of the male blade attaches with the female blade handle side which has at least two inwardly projection grooves sized and shaped to engage the L-shaped grooves of the male blade.
Figure 12B:
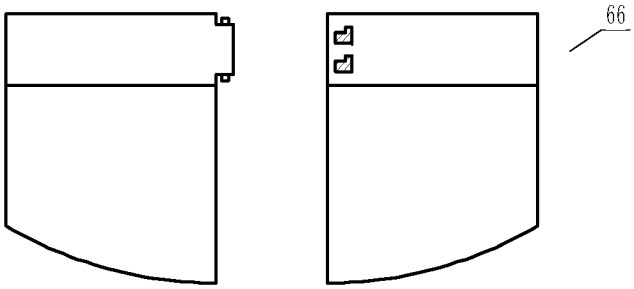
FIG. 12B. Is a front elevation view of another embodiment wherein the first blade and second blade are attached with a bayonet type connection where button type fittings on the male blade attach to L-shaped grooves on the female blade and twist to lock into place.
Figure 13E:
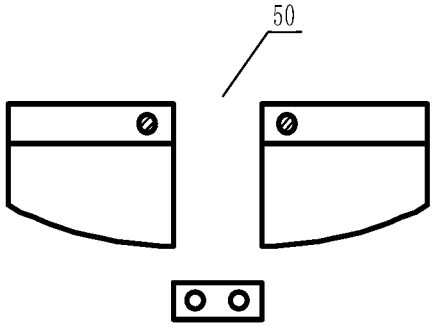
FIG. 13E. Is a front elevation view of another embodiment wherein the first blade and second blade are attached with a male connector that attaches to female holes or rivets in the handle side of the first blade and second blade.
Figure 13F:
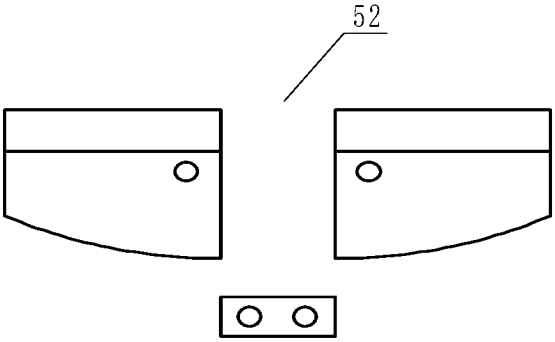
FIG. 13F. Is a front elevation view of another embodiment wherein the first blade and second blade are attached with a male connector that attaches to female holes or rivets in the blades of the first knife and second knife.
Figure 13G:
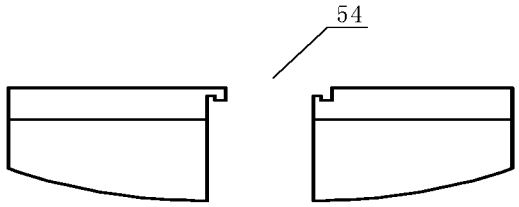
FIG. 13G. Is a front elevation view of another embodiment wherein the first blade and second blade are attached with a male fitting on the end of the handle side of one blade connecting to a female gap on the end of the handle side of the other blade.
Figure 13H:
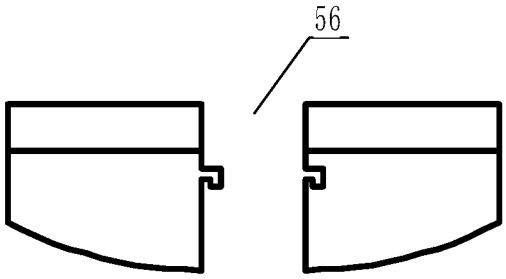
FIG. 13H. Is a front elevation view of another embodiment wherein the knives are attached by a male fitting on the end of the blade attaching to a female gap on the end of the blade of the other knife.
Figure 13I:
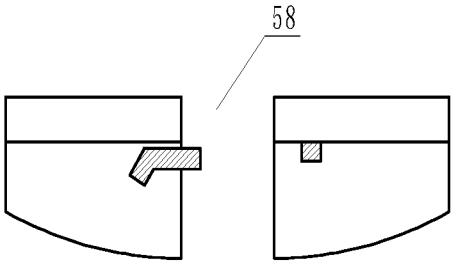
FIG. 13I. Is a front elevation view of another embodiment wherein the first blade and second blade are attached with a connector that swivels out from the blade of one knife and connects to a hole or notch in the blade of the other knife.

Other embodiments include the first blade and second blade being attached with a screw type connection wherein one blade has a male member protruding from the handle side with threading on the exterior and the other blade has a female connection in the handle side with threading on the interior as referenced in FIG. 11. Referencing FIG. 13E, numeral 50, is another embodiment wherein the first blade and second blade are attached with a male connector that attaches to female holes or rivets in the handle side of the first blade and second blade. Referencing FIG. 13F, numeral 52, is another embodiment wherein the first blade and second blade are attached with a male connector that attaches to female holes or rivets in the blades of the first knife and second knife. Referencing FIG. 13G, numeral 54, is another embodiment wherein the first blade and second blade are attached with a male fitting on the end of the handle side of one blade connecting to a female gap on the end of the handle side of the other blade. Referencing FIG. 13H, numeral 56, is another embodiment wherein the first blade and second blade are attached with a male fitting on the end of the back side of one blade connecting to a female gap on the end of the back side of the other blade. Referencing FIG. 13I, numeral 58, is another embodiment wherein the first blade and second blade are attached with a connector that swivels out from the blade of one knife and connects to a hole or notch in the blade of the other knife. Referencing FIG. 12A, numeral 64, is another embodiment wherein the first blade and second blade are attached with a bayonet type connection where outwardly projecting L-shaped grooves from a slightly extended handle side of the male blade attaches with the female blade handle side which has at least two inwardly projection grooves sized and shaped to engage the L-shaped grooves of the male blade. Or another embodiment referencing FIG. 12B, numeral 66, wherein the first blade and second blade are attached with a bayonet type connection where button type fittings on the male blade attach to L-shaped grooves on the female blade and twist to lock into place.

It will be understood that certain features and sub-combinations are of utility and may be employed without reference to other features and sub-combinations. Since many possible embodiments may be made of the invention without departing from the scope thereof, it is to be understood that all matter herein set forth or shown in the accompanying drawings is to be interpreted as illustrative and not in a limiting sense.

What I claim is:

1. A dual knife food cutter apparatus configurable into a cutting configuration and a storage configuration, comprising a first blade and a second blade:

each said blade made of rigid material comprising a cutting side of the blade, a front side adjacent to the cutting side, a back side opposite of the front side substantially perpendicular to the cutting side, and a handle side opposite to the cutting side and substantially parallel to the cutting side, said handle side comprising a hollow channel fixedly attached to the blade and a slot in the channel wherein the slot of the first blade is sized to allow insertion of the cutting side of the second blade;

and a connector sized for insertion into the hollow channel of the handle side of the first blade and the hollow channel of the handle side of the second blade;

wherein in the cutting configuration, the back side of the first blade abuts the back side of the second blade, the cutting side of the first blade and the cutting side of the second blade form a substantially contiguous combined cutting side; and wherein in the storage configuration, the cutting side of the first blade is inserted into the slot of the handle side of the second blade and the cutting side of the second blade is inserted into the slot of the handle side of the first blade.

2. The dual knife food cutter apparatus of claim 1 wherein the cutting side of the first blade and the cutting side of the second blade have a sharpened edge.

3. The dual knife food cutter apparatus of claim 1 wherein the cutting side of the first blade and the cutting side of the second blade have a convex edge.

4. The dual knife food cutter apparatus of claim 1 wherein the handle side of the first blade further comprises holes and the connector further comprises spring clip buttons wherein the holes and spring clip buttons are aligned to secure the connector into the handle side of the first blade when in the cutting configuration.

5. The dual knife food cutter apparatus of claim 1 wherein the handle side of the first blade is formed integrally from the same material as the cutting side.

6. The dual knife food cutter apparatus of claim 1 wherein the handle side of the first blade and the connector are cylindrical shaped tubes.

7. The dual knife food cutter apparatus of claim 1 wherein the handle side of the first blade and the connector comprise a polygon shaped cross section.

8. The dual knife food cutter apparatus of claim 1 wherein the cutting side of the first blade further comprises a Granton edge.

9. The dual knife food cutter apparatus of claim 1 wherein the cutting side of the first blade further comprises a serrated edge.

* * * * *